US006328624B1

(12) United States Patent
Segan et al.

(10) Patent No.: US 6,328,624 B1
(45) Date of Patent: Dec. 11, 2001

(54) COMBINATION TIMEPIECE AND YO-YO

(75) Inventors: Marc H. Segan, New York; Gary Strauss, Mamaroneck, both of NY (US)

(73) Assignee: M. H. Segan Limited Partnership, Great Barrington, MA (US)

( * ) Notice: Subject to any disclaimer, the term of this patent is extended or adjusted under 35 U.S.C. 154(b) by 0 days.

(21) Appl. No.: 09/551,904

(22) Filed: Apr. 19, 2000

Related U.S. Application Data

(60) Provisional application No. 60/130,839, filed on Apr. 22, 1999.

(51) Int. Cl.[7] ..... A63H 1/30
(52) U.S. Cl. ..... 446/250; 968/406
(58) Field of Search ..... 446/247, 248, 446/250; 368/10, 45; 968/398, 406

(56) References Cited

U.S. PATENT DOCUMENTS

| | | | | |
|---|---|---|---|---|
| D. 346,558 | | 5/1994 | Hiromori | D10/31 |
| 3,136,551 | | 6/1964 | Ruderian | 273/142 |
| 4,456,384 | * | 6/1984 | Murakami | 968/406 |
| 4,571,199 | * | 2/1986 | Murakami | 968/406 |
| 4,632,245 | | 12/1986 | Lerner | 206/315 |
| 4,895,547 | | 1/1990 | Amaral | 446/250 |
| 5,145,444 | | 9/1992 | VanKuiken | 446/242 |
| 5,842,574 | | 12/1998 | Nunes | 206/575 |

* cited by examiner

*Primary Examiner*—Sam Rimell
(74) *Attorney, Agent, or Firm*—Cohen, Pontani, Lieberman & Pavane

(57) ABSTRACT

A yo-yo has a recess in one of its faces accommodating a timepiece. The yo-yo is be releasably accommodated in a base, and the base may be worn on a user's person by various means including a wristband in the manner of a wristwatch, a fob or a watch chain in the manner of a pocket watch, a necklace in the manner of a necklace watch, or a holster.

16 Claims, 9 Drawing Sheets

COMBINATION TIMEPIECE AND YO-YO

CROSS-REFERENCE TO RELATED APPLICATIONS

This application claims the benefit of Provisional Application No. 60/130,839, filed Apr. 22, 1999.

BACKGROUND OF THE INVENTION

1. Field of the Invention

The present invention relates to yo-yos, and particularly to a yo-yo incorporating a time indicating element.

2. Description of the Related Art

Yo-yos have been known for many years and exist in a variety of forms and adaptations. Typically, existing yo-yos serve a single function, namely, that of entertainment. In recent times modem technology has been used to enhance the yo-yo's entertaining function by including various visual and audible features as well as to improve the yo-yo's operability such as by improving the yo-yo's ability to "sleep", i.e., to spin at a constant vertical position for a length of time. For example, U.S. Pat. No. 5,145,444 (VanKuiken) discloses a yo-yo utilizing light emitting diodes connected to a circuit for illumination when the yo-yo is in use. Similarly, U.S. Pat. No. 5,791,966 (Capps et al.) uses a string of synchronized light emitting diodes to display messages stored in a memory circuit contained in a yo-yo housing. Also, U.S. Pat. No. 4,895,547 (Amaral) discloses a yo-yo having an improved "sleeping" performance by incorporating a free spinning spool about the yo-yo axle.

While the various mechanical and electrical improvements to yo-yos discussed in the aforementioned patents are interesting, they do not provide additional benefits or functions to the yo-yo other than the primary entertainment purpose, and do not provide a convenient yo-yo carrying mechanism or feature.

SUMMARY OF THE INVENTION

In accordance with the present invention, a yo-yo is provided having a mountable feature to allow the yo-yo to be conveniently carried on a user's wrist as a wristwatch, and including a timekeeping feature to allow the yo-yo to be used as a wristwatch. The inventive yo-yo is releasably mounted to a wrist brace or holder worn by the user. In operation, the yo-yo is released from the wrist base and can then be used as a conventional yo-yo. When the yo-yo is not in use, it can be easily remounted to the wrist mount base in a manner which displays the timekeeping function so that the yo-yo can be used as a wristwatch.

The releasable connection between the yo-yo and the wrist mount is preferably in the form of a snap type arrangement where a base is fastened to a wrist brace, and includes a support member under which a back half of the yo-yo is inserted and a detent member opposite the barlike member which snaps onto the back half of the yo-yo as the yo-yo is pressed into the base. The detent member is releasable by finger pressure to permit removal of the yo-yo from the base.

In an alternative embodiment, the releasable connection between the yo-yo and the wrist mount is configured as a lock and key or bayonet arrangement wherein a centrally located key hole is formed in the yo-yo housing for mating with a key or protrusion formed on the wrist mount base. To secure the yo-yo to the wrist mount base, the yo-yo is simply placed over the key so that the key enters the keyhole, whereupon the yo-yo is rotated about the yo-yo axis for locking it in place. In another embodiment, radially-spaced prongs are formed on the wrist mount which create a living spring arrangement about the yo-yo housing for providing releasable securement of the yo-yo to the wrist mount.

In another embodiment, a separate timekeeping function may be included on the wrist mount base so that a wearer can determine the time while the yo-yo is in operation.

In another embodiment, the yo-yo is releasably mounted in a fob, with provision for releasably attaching the fob to a portion of a user's clothing, such as a belt loop.

In another embodiment, the yo-yo is releasably mounted in a holster adapted to be worn on a user's person. The holster may additionally contain parts and tools for maintenance of the yo-yo.

In another embodiment, the yo-yo is releasably mounted in a base to which is attached one end of a chain, and the other end of the chain may be fastened to a portion of the user's clothing, enabling the yo-yo to be worn in the manner of a pocket watch.

In another embodiment, the yo-yo is releasably mounted in a base to which is attached a loop of cord or chain for wearing around a user's neck.

In another embodiment, the yo-yo is releasably mounted in a base which is attached to a glove for wearing on a user's hand.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements.

DETAILED DESCRIPTION OF THE PRESENTLY PREFERRED EMBODIMENTS

Figure 1:
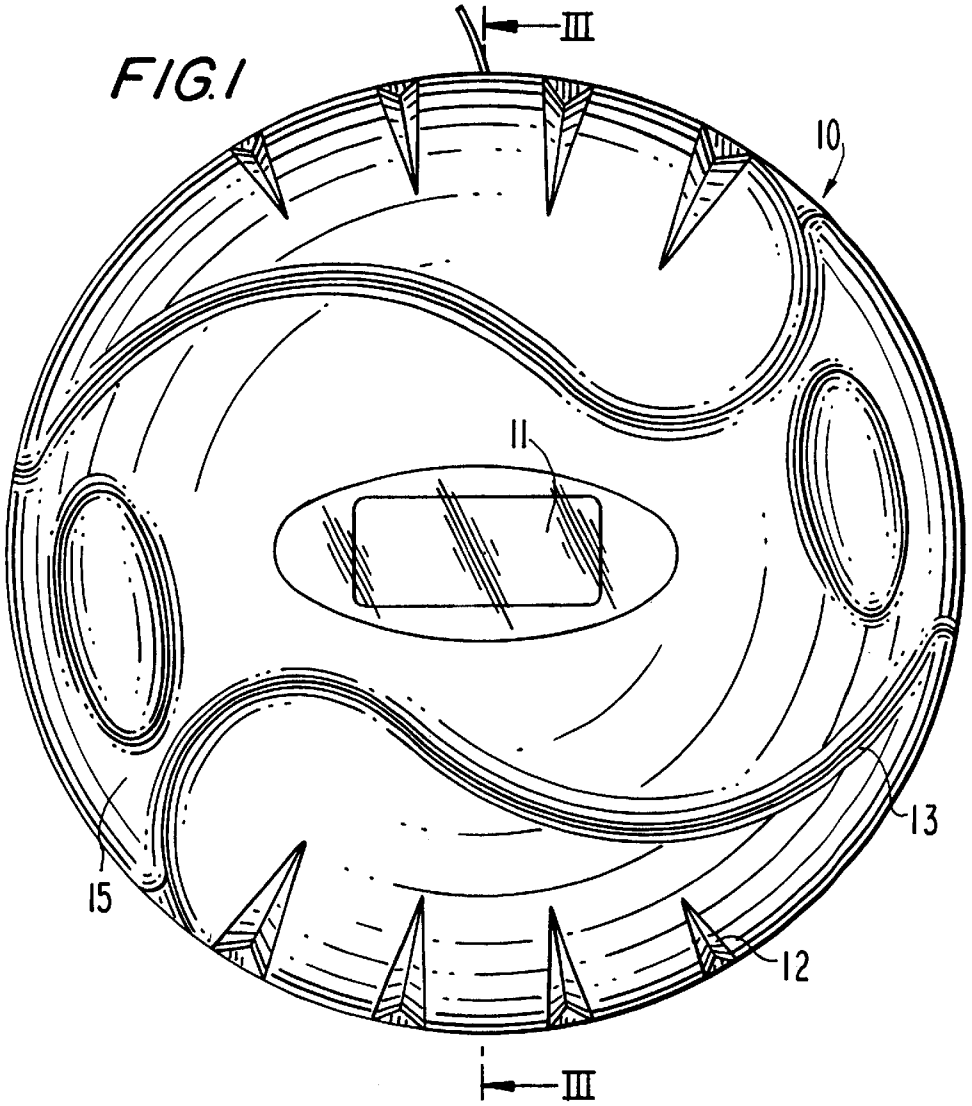
FIG. 1 is a front view of a yo-yo of the present invention showing certain surface design elements.
Figure 2:
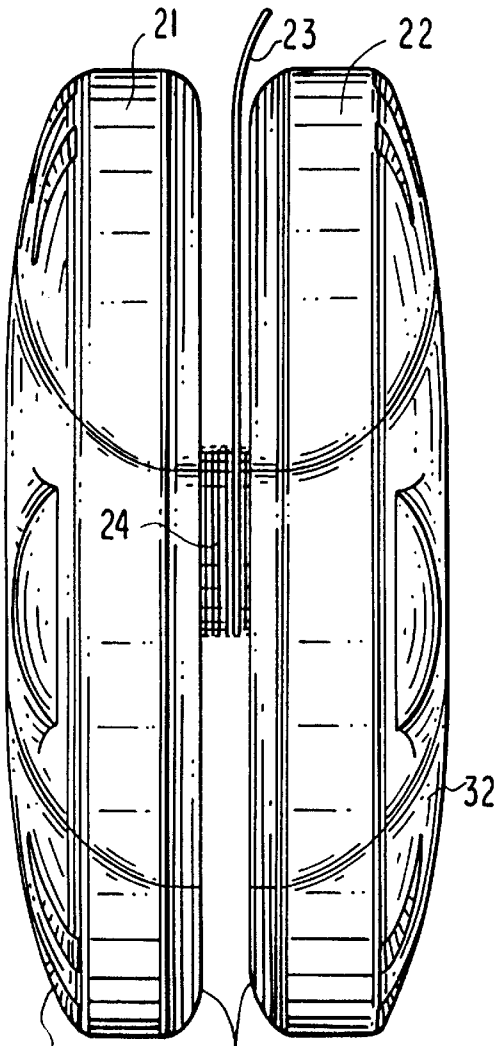
FIG. 2 is a side view of the yo-yo as shown in FIG. 1.

With reference to FIG. 1, a yo-yo 10 according to the present invention is shown having a housing 15 in which a time indicating window 11 is formed at the center thereof for displaying to a user the time generated by a standard clock-timing circuit as is readily known by those having ordinary skill in the art. The yo-yo housing 15 may be decorated with design textures such as spikes 12 and elongated grooves 13. The yo-yo housing 15 is viewed in FIG. 2 has a back portion or half 21 and a front portion or half 22 which are joined at a center of rotation by a centrally located axle 24 to which a string 23 is attached, such as by tying or knotting. As is known, the string 23 is used for operating the yo-yo in a conventional manner.

Figure 3:
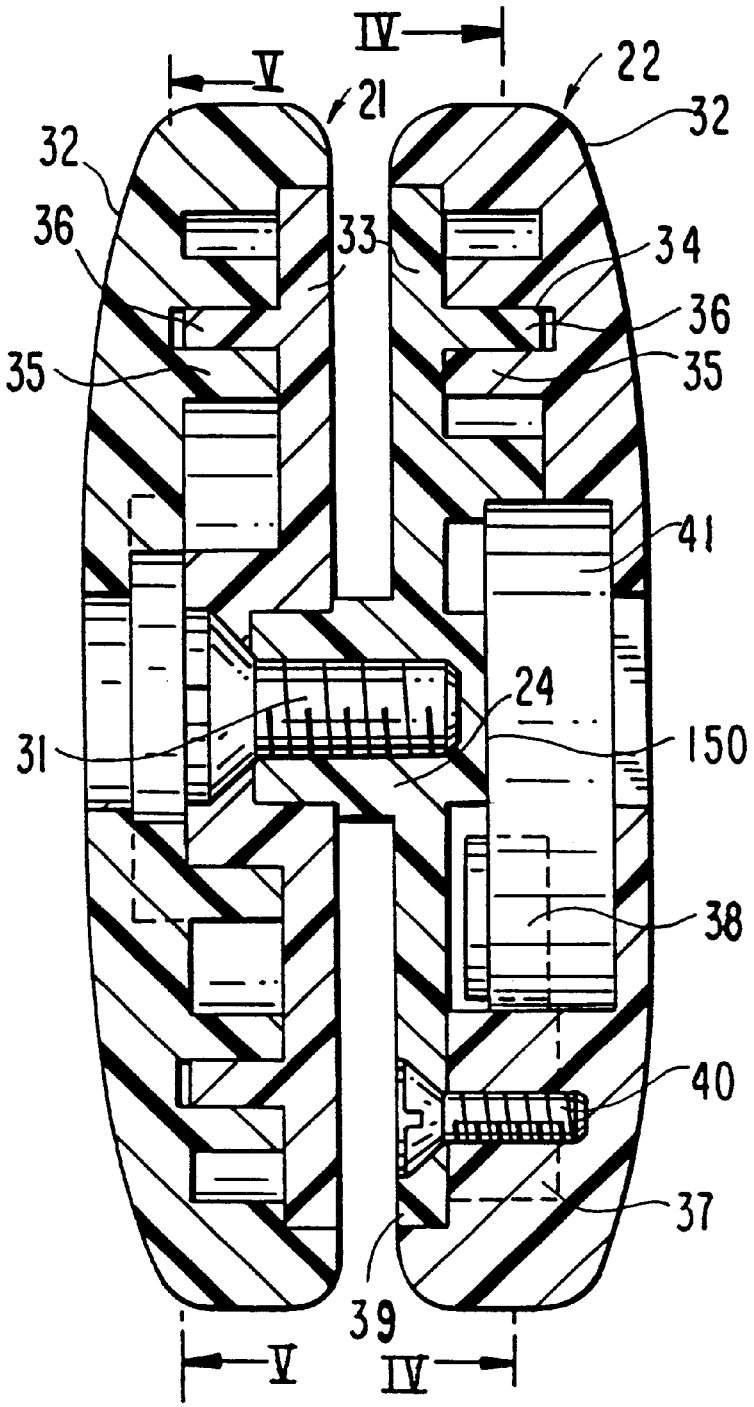
FIG. 3 is a cross-sectional view of the yo-yo along the line III—III as shown in FIG. 1.
Figure 4:
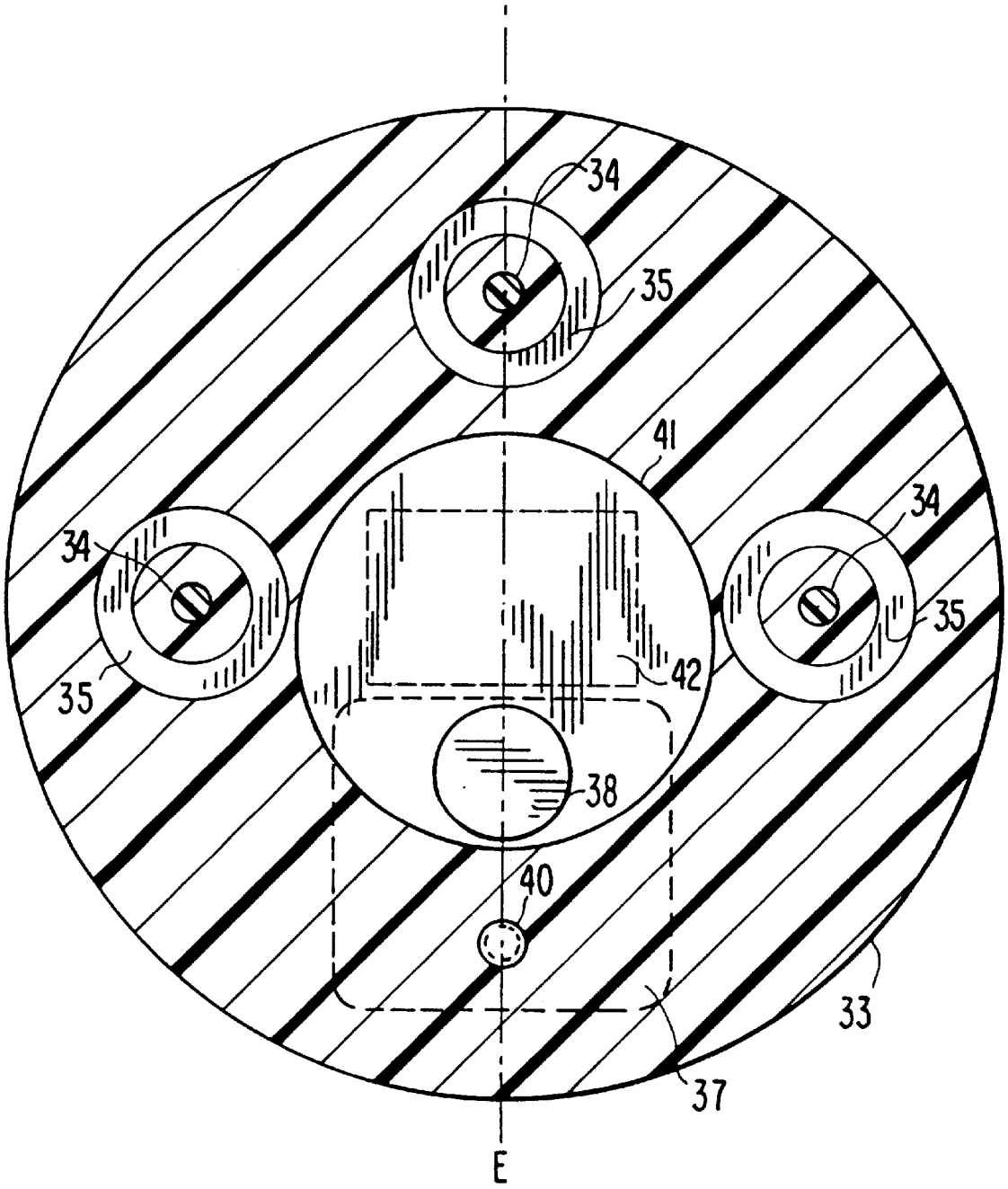
FIG. 4 is a cross-sectional view of the yo-yo along the line IV—IV as shown in FIG. 3.

Turning now to FIGS. 3 and 4, the back half 21 and front half 22 are connected by a fastener such as a bolt or screw 31 which passes through the axle 24. Each housing half has an exterior portion 32 and an interior portion 33. The two portions are assembled and held together through a plurality of press fit connectors 34, with each connector having a column or post 35 extending from section 33 which mates with a corresponding recess or insert 36 formed in section 32 of the same housing half for providing a friction fit between the two sections. In the alternative, the post 35 can be designed as extending from section 32 for mating with recesses formed in section 33 to form a friction fit therebetween.

Approximately in the center of the front half 22 is a cavity that hosts a timekeeping device 41. The timekeeping device 41 is preferably an electronic device as is known in the art, having an LCD digital display or the like and operable from a button cell battery housed in a chamber 37, or from solar energy obtained from a solar collector mounted on the face of the front half 22 along with the timepiece (not shown). As an alternative, the timekeeping device may be mechanical having an analog display and operable from a spring which can be charged by winding, as in a conventional wristwatch, or by operation of the yo-yo which causes recharging of the spring. In either case, it is preferred that the time keeping device 41 be of relatively light weight with respect to the weight of the yo-yo so that the yo-yo will remain balanced and operate in its intended manner. In the event the time keeping device 41 is constructed as having a significant weight, the back half of the yo-yo may be constructed with additional weight to balance the yo-yo to provide for proper operation.

Figure 5:
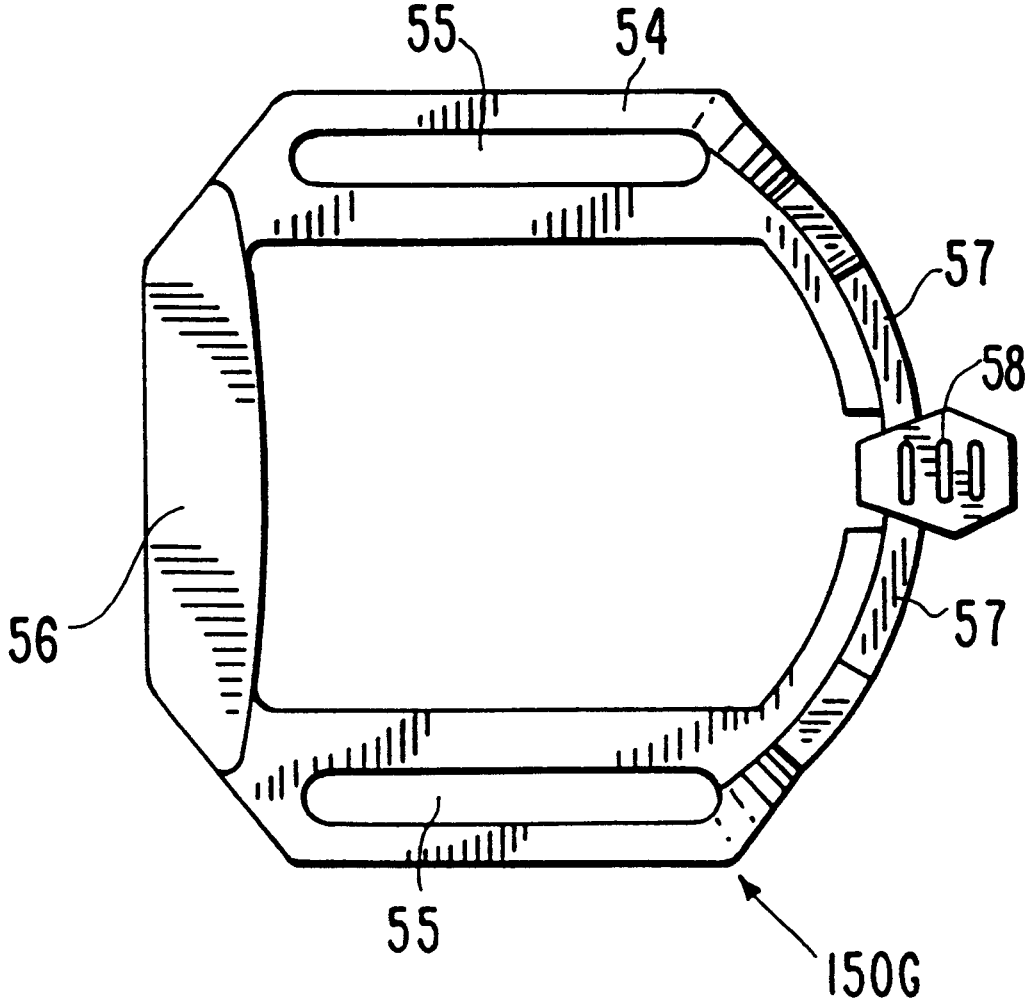
FIG. 5 is a top view of a wrist mount base on which the yo-yo is releasably mounted.

With reference to FIG. 5, the combination yo-yo and wristwatch of the present invention includes a wrist mount base 150G having a bottom 54. Bottom 54 has a pair of slots 55 through which a wrist strap (not shown) passes to fasten base 150G thereto. Yo-yo 10 is placed against base 150G so that a peripheral portion of back half 21 is under barlike member 56 and an opposite peripheral portion of back half 21 is against the top of detent 58. Detent 58 is fastened to base 54 by flexible arms 57, so that pressure on yo-yo 10 can deflect detent 58 sufficiently to permit yo-yo 10 to pass it and rest flat against bottom 54, whereupon detent 58 returns to its normal position and is detaining back half 21 of yo-yo 10 against bottom 54. Finger pressure on detent 58 deflects it sufficiently to permit removal of yo-yo 10.

Figure 6:
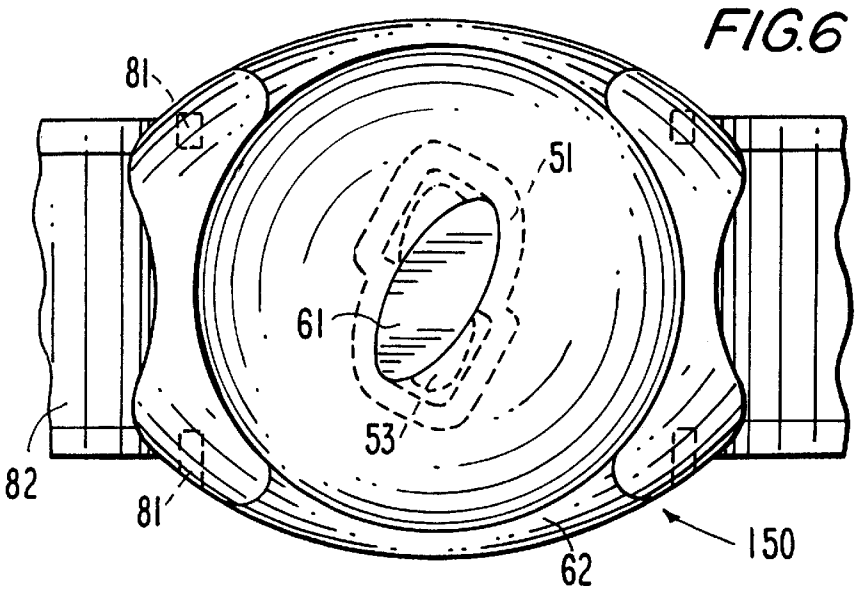
FIG. 6 is a front view of an alternative wrist mount base on which the yo-yo is releasably mounted.
Figure 7:
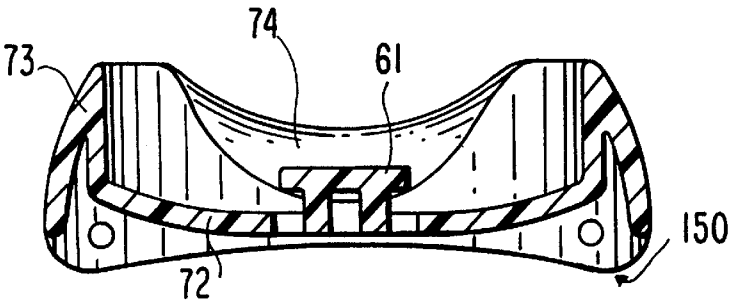
FIG. 7 is a cross-sectional view of the wrist mount base along line VII—VII as shown in FIG. 6.
Figure 8:
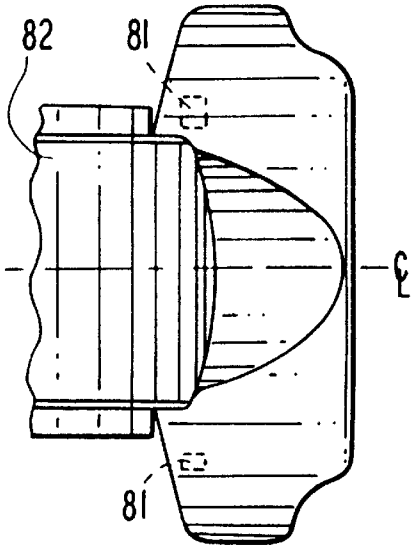
FIG. 8 is a left side view of the wrist mount base as shown in FIG. 7.
Figure 9B:
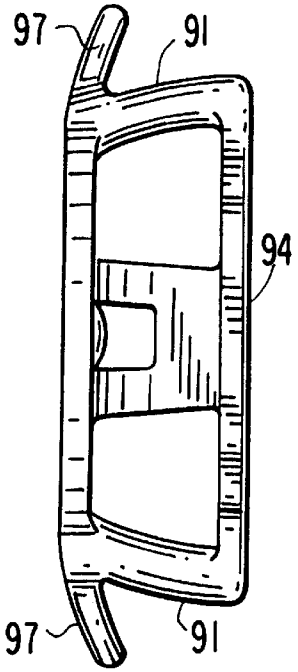
FIGS. 9*a*–9*d* depict various views of an alternative embodiment of a wrist mount base for use with a yo-yo.
Figure 9A:
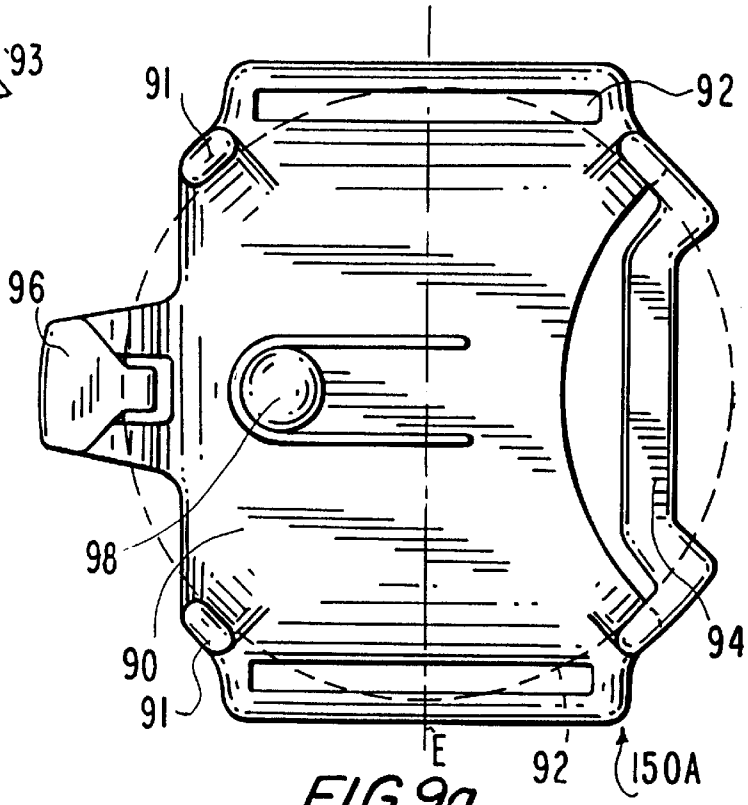
Figure 9C:
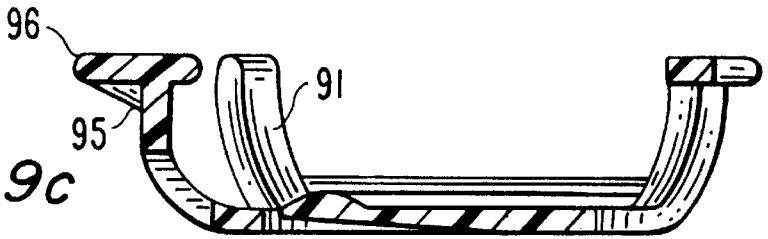
Figure 9D:
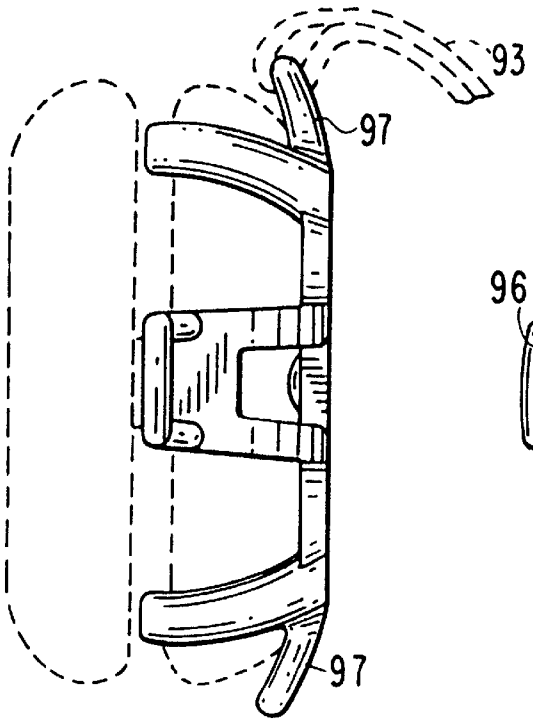

With reference now to FIGS. 6 and 7, the combination yo-yo and wristwatch of the present invention includes an alternative wrist mount base 150 having a bottom edge 72 surrounded by a rim 73 for forming a rounded interior space or cup 74 for accommodating insertion of the back half portion 21 of the yo-yo 10. The yo-yo is removably secured to the wrist mount base 150 via a securing means such as a key or protrusion 61 mounted to the wrist mount base 150 for mating with a keyhole or opening 52 formed in the back half 21 of yo-yo 10. As shown in FIG. 6, the keyhole 52 is surrounded by a set-off wall 51 and forms a bayonet-type engagement wherein the yo-yo 10 is coupled to base 150 by aligning key 61 with keyhole 52 in a manner as shown in FIG. 5, and rotating yo-yo 10 to the position shown in FIG. 6. The yo-yo can then be re-released by rotating, in an opposite direction, to remove key 61 from keyhole 52.

With continued reference to FIG. 6, the wrist base 150 is mounted to a wrist band or strap 82 for allowing the wrist base 150 with the yo-yo 10 connected thereto, to be worn on a user's wrist, in a manner similar to that of a wristwatch. The wrist band 82 is connected to the wrist base by pins or fasteners 81. As an alternative, a portion of the wrist band may pass through a bottom portion of the wrist base 150 to secure the wrist base to the strap 82. The wrist band 82 may be constructed from any suitable type of band material such as, for example, leather, cloth, plastic, etc., having a fastening mechanism at each band end for allowing the band to be fastened to the user's wrist. When worn in this manner with the yo-yo attached thereto, the timekeeping device 41 of the yo-yo is oriented in a direction upward away from the user's wrist to allow a user to view the timekeeping device by simply glancing at the yo-yo 10.

Another embodiment of the wrist mount base is depicted in FIGS. 9*a*–9*d*. In this embodiment, the base 150A has a bottom surface 90 having a plurality of protrusions or hooks 91 which, along with a brace 94, are positioned to accommodate insertion of the yo-yo 10. The hooks 91 are attached to the bottom surface 90 to form a memory/living spring arrangement whereby one or more of the hooks can bend outward to accommodate insertion of the yo-yo. Once the yo-yo is in place between the hooks 91 and brace 94, one or more of the hooks 91 will spring back against the yo-yo housing to secure the yo-yo in place.

Base 150A may be mounted to the strap by utilizing loops 92 formed in the base to accommodate insertion of the strap therethrough. As an alternative, hooks 97 may optionally be provided for facilitating fastening of the strap. In another embodiment, a spring 98 may be included on base 150A to bias the yo-yo 10 in an upward direction against the upper edges of hooks 91 when the yo-yo is placed in the base 150A to maintain friction contact between the yo-yo and the hooks 91 to prevent the yo-yo from detaching from the base 150A. When a user wishes to remove the yo-yo from the base, the user simply grasps the yo-yo and angles the yo-yo outward from the base to release it therefrom.

In other embodiments of the present invention, the yo-yo is deployed in vehicles other than a wrist strap. Means of releasably mounting the yo-yo in these other vehicles can be the same as the means for releasably mounting it in the wrist strap; i.e., bases analogous to bases 150 or 150A are integral to the vehicles.

Figure 10:
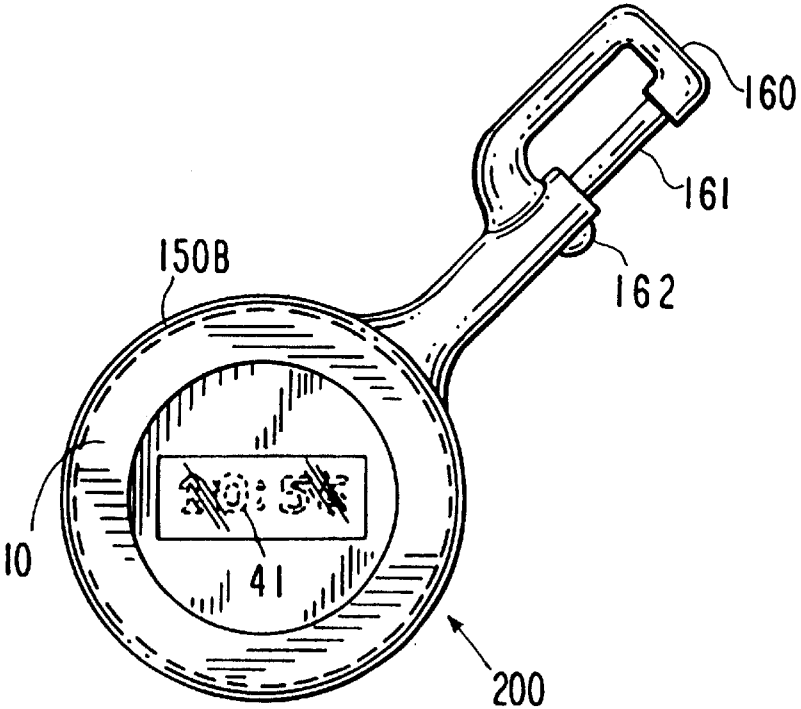
FIG. 10 depicts the yo-yo of the present invention deployed in a fob.

FIG. 10 depicts yo-yo 10 deployed in a fob 200. Base 150B is integral to fob 200, with yo-yo 10 releasably mounted therein. Fob 200 includes a hook 160 for hooking onto, for example, a belt loop of a user's clothing. Pawl 161 prevents hook 160 from accidentally becoming unhooked.

Unhooking may be accomplished by using release 162 to retract pawl 161.

Figure 11:
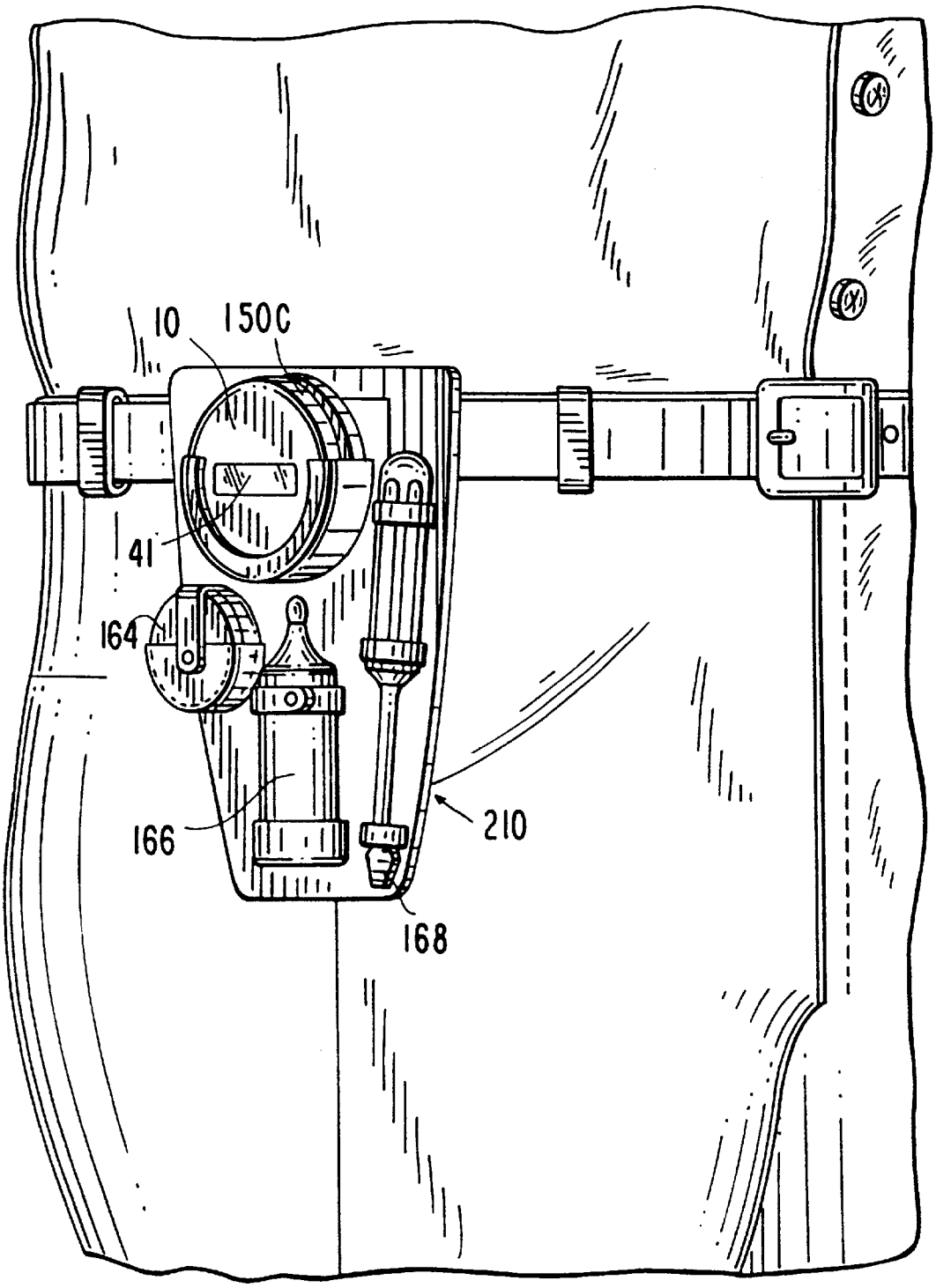
FIG. 11 depicts the yo-yo of the present invention deployed in a holster.

FIG. 11 depicts yo-yo 10 deployed in a holster 210. Base 150C is integral to holster 210, with yo-yo 10 releasably mounted therein. As is known, holster 10 may be made to be attachable, for example, to a user's belt. In a present embodiment, holster 210 contains other miscellaneous items usable for the maintenance of yo-yo 10: i.e., extra string 164, oil dispenser 166, and screwdriver 168.

Figure 12:
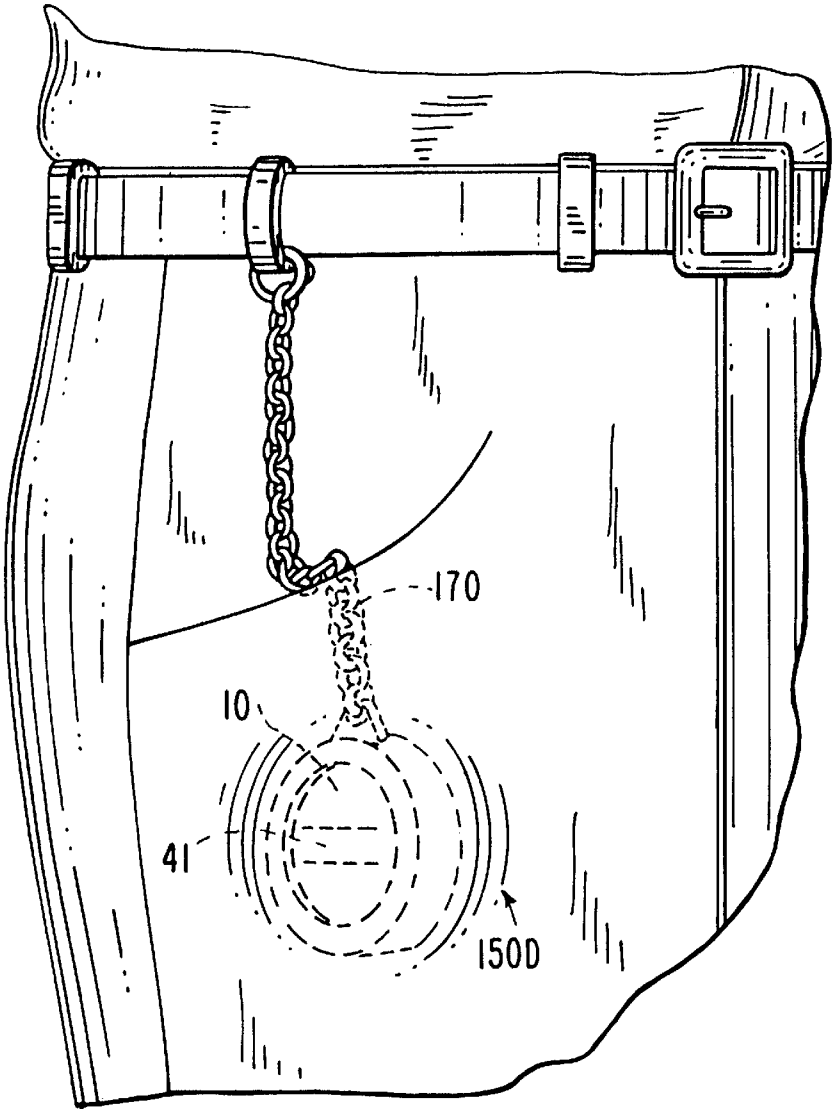
FIG. 12 depicts the yo-yo of the present invention deployed in the manner of a pocket watch.

FIG. 12 depicts yo-yo 10 deployed in the manner of a pocket watch. Yo-yo 10 is releasably mounted in base 150D. Base 150D, in turn, is fastened to an end of chain 170. The other end of chain 170 may be fastened to a user's clothing as is known in the art.

Figure 13:
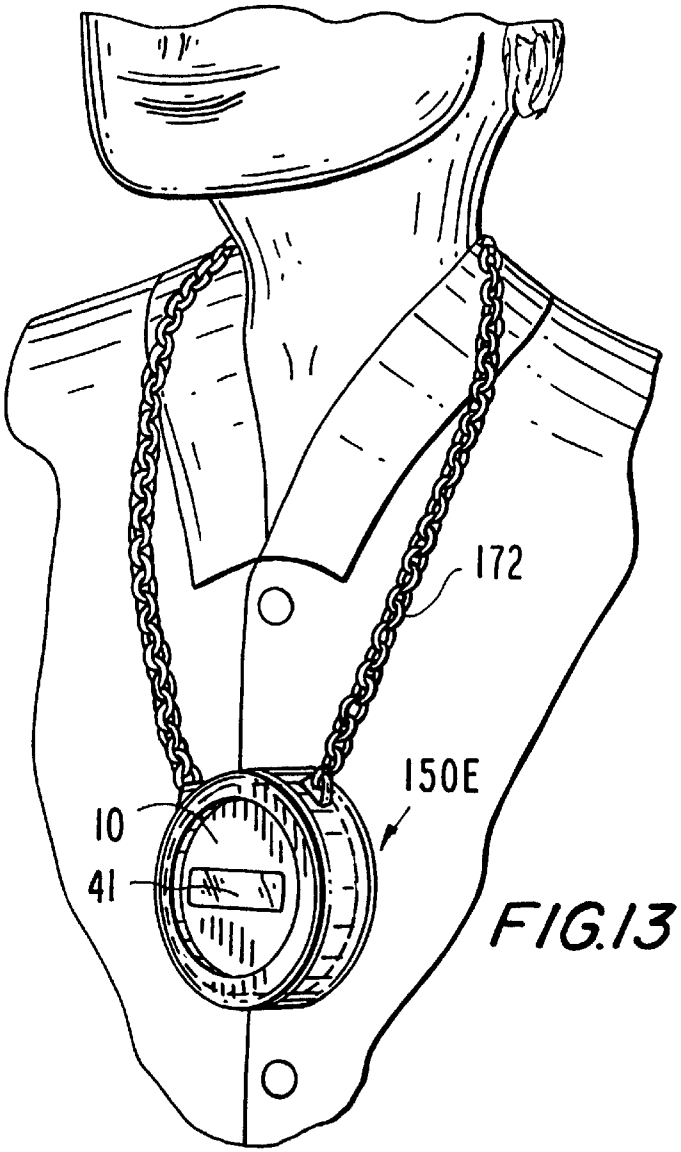
FIG. 13 depicts the yo-yo of the present invention deployed in the manner of a necklace watch.

FIG. 13 depicts yo-yo 10 releasably mounted in base 150E, which has attached to it a chain or cord 172 for wearing around a user's neck.

Figure 14:
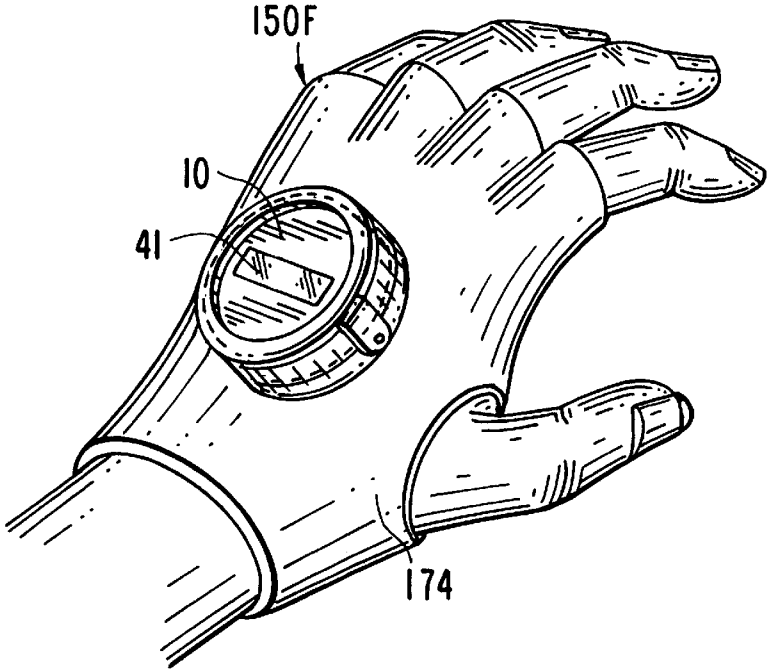
FIG. 14 depicts the yo-yo of the present invention deployed on the back of a glove.

FIG. 14 depicts yo-yo 10 releasably mounted in a base 150F which is joined to a glove for wearing on a user's hand.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A toy, comprising:

a yo-yo having a substantially disklike first portion and a substantially disklike second portion coaxially joined at a center of rotation by an axle, said first portion having an outer face defining a recess in which a timepiece is mounted and arranged to be outwardly visible;

a base; and flexible means for releasably securing said second disklike portion to said base.

2. The toy of claim 1, wherein the timepiece is an electronic timepiece.

3. The toy of claim 2, wherein the first portion further accommodate a battery for powering the timepiece.

4. The toy of claim 2, further including solar collector means for powering the timepiece.

5. The toy of claim 2, wherein the timepiece is a spring-driven mechanical timepiece.

6. The toy of claim 5, wherein the spring is wound by operation of the yo-yo.

7. The toy of claim 1, further comprising a wristband releasable attached to said base for mounting said base to a user's wrist.

8. The toy of claim 1, wherein said base is attachable to a fob for attaching to a user's clothing.

9. The toy of claim 1, wherein said base is attachable to a first end of a cordlike member of which the second end is arranged for fastening to a user's clothing.

10. The toy of claim 1, wherein said base is attachable to a cordlike loop arranged for wearing around a user's neck.

11. The toy of claim 1, wherein said base is attachable to a glove for wearing on a user's hand.

12. The toy of claim 1, wherein said base is attachable to a holster.

13. The toy of claim 12, wherein the holster is arranged to be worn on clothing of a user.

14. The toy of claim 12, wherein the holster is arranged to accommodate parts and tools for maintenance of the yo-yo.

15. A toy, comprising:

a yo-yo having a substantially disklike first portion and a substantially disklike second portion coaxially joined at a center of rotation by an axle, said first portion having an outer face defining a recess in which a timepiece is mounted and arranged to be outwardly visible, and said second portion having an outer face defining a recess; and base having an upwardly extending protrusion rotatably releasably engageable with said second portion recess for releasably mounting said yo-yo to said base.

16. A toy, comprising:

a yo-yo having a substantially disklike first portion and a substantially disklike second portion coaxially joined at a center of rotation by an axle so that a space is formed between said first and second portions, said first portion having an outer face defining a recess in which a timepiece is mounted and arranged to be outwardly visible; and a base, said base having a bottom, a fixed wall and a moveable wall, said fixed wall and said moveable wall connected to said bottom for defining a receiving area for accommodating said second disklike portion, said moveable wall being spaced from said fixed wall and outwardly moveable relative thereto, said moveable wall having a hooked distal end for seating within said space when said second disklike portion is disposed in said receiving area.

* * * * *